US005287661A

United States Patent [19]

Benner

[11] Patent Number: 5,287,661

[45] Date of Patent: Feb. 22, 1994

[54] DEVICE FOR SHARPENING MULTIPLE FISH HOOKS

[76] Inventor: Robert L. Benner, c/o TBW Industries, Forest Grove Rd., Furlong, Pa. 18925

[21] Appl. No.: 83,605

[22] Filed: Jun. 30, 1993

[51] Int. Cl.[5] ..... B24D 15/06

[52] U.S. Cl. ..... 51/205 WG; 51/214; 76/86

[58] Field of Search ..... 51/205 WG, 205 R, 211 R, 51/211 H, 212, 214, 354, 181 R, 181 NT, 285, 392; 7/106; 76/82, 86; 29/9

[56] References Cited

U.S. PATENT DOCUMENTS

| | | | |
|---|---|---|---|
| 185,424 | 12/1876 | Barker . | |
| 190,115 | 5/1877 | Babcock et al. . | |
| 500,504 | 6/1893 | Moore | 51/392 |
| 1,898,422 | 2/1933 | Champlin | 7/106 |
| 3,708,924 | 1/1973 | Prunchak | 51/392 |
| 4,272,925 | 6/1981 | Graves | 51/211 R |
| 4,696,129 | 9/1987 | Roberts | 51/214 |
| 4,747,235 | 5/1988 | Priebe | 51/211 |
| 4,835,910 | 6/1989 | Roberts | 51/285 |
| 4,852,305 | 8/1989 | Juranitch | 51/211 R |

FOREIGN PATENT DOCUMENTS

| | | | |
|---|---|---|---|
| 1061204 | 4/1954 | France | 51/211 H |
| 0190784 | 5/1937 | Switzerland | 51/211 H |
| 0008645 | 8/1932 | United Kingdom | 51/212 |

*Primary Examiner*—Robert A. Rose
*Attorney, Agent, or Firm*—Eugene Chovanes

[57] ABSTRACT

A hand-held device is described for simultaneously sharpening the points of multiple fish hooks, particularly double and treble hooks in which the concave hook sharpening member is provided with abrasive surfaces for honing the hook points by longitudinal movement of the hook in the device.

2 Claims, 1 Drawing Sheet

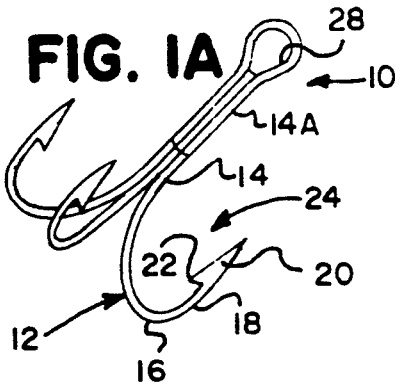
FIG. 1A
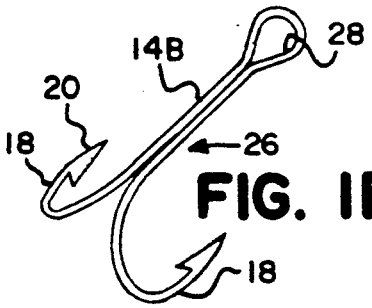
FIG. 1B
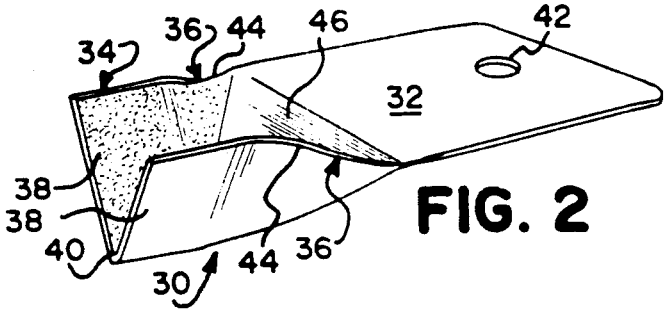
FIG. 2
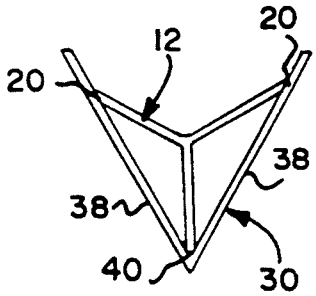
FIG. 4
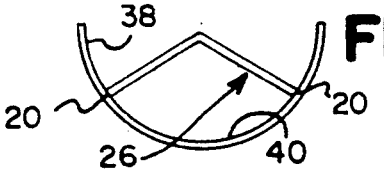
FIG. 6
FIG. 3
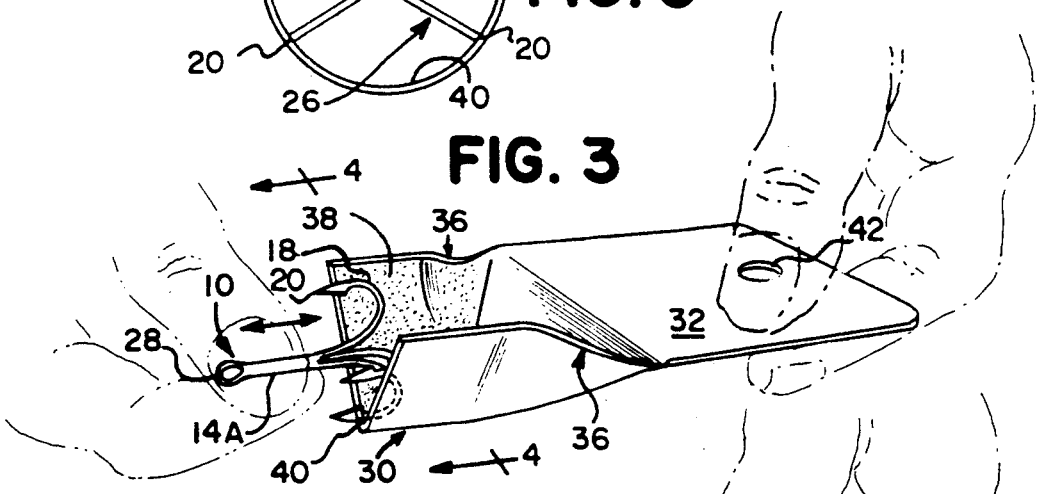
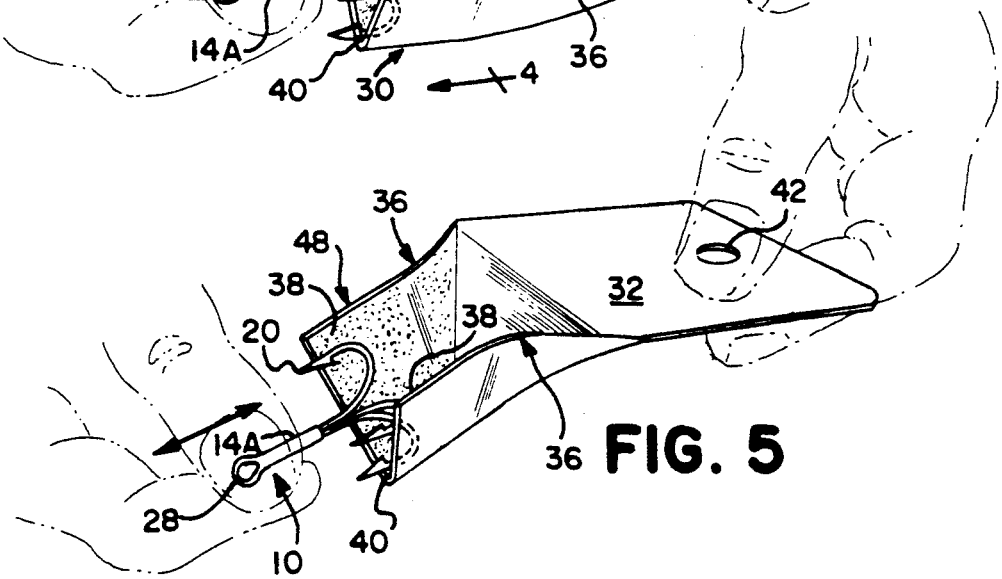
FIG. 5

DEVICE FOR SHARPENING MULTIPLE FISH HOOKS

The present invention relates to a device for individual use to sharpen fish hooks and, more particularly, to such a device capable of simultaneously sharpening the points of a multiple fish hook.

The art of fishing is, of course, ancient and the use of hooks for this purpose has been common since the earliest times. As any fisherman knows, the chances of successfully hooking a fish depend very largely upon the sharpness of the points of the hooks employed. For this reason, the sharpening of fish hooks has received much attention in the art. Many devices have been employed for this purpose, both at the point of manufacture and in the hands of the end user; the latter being the concern of the present invention. The devices most widely employed for this purpose have been files and hones.

Files for sharpening fish hooks are generally formed of flat metal bars with transverse cutting ridges or teeth. Some hones for fish hooks are rod-like and designed to stroke the hook point. Other hones of the prior art for sharpening fish hooks have one or more grooves within which the point of the hook may be drawn in contact with an abrasive surface such as Carborundum. Such devices are capable of sharpening only one point of a hook at a time. This is tedious and time-consuming, especially in the case of double or treble hooks; particularly with lures having several treble hooks, as is commonly the case.

This problem has been recognized in the art as evidenced by U.S. Pat. Nos. 4,696,129 and 4,835,910 issued Sep. 29, 1987 and Jun. 6, 1989, respectively, to Timothy A. Roberts, which describe devices and methods primarily intended for honing a plurality of blades of a broadhead hunting arrow, but which are also said to be useful for sharpening treble fish hooks.

U.S. Pat. No. 190,115 issued May 1, 1877 to Babcock et al, while not directed to the sharpening of fish hooks, describes a dental tool constructed of soft copper, or other suitable metal, and having working surfaces in which particles of finely pulverized diamond are embedded by being rolled or pressed into the soft metal to provide an abrasive surface.

U.S. Pat. No. 185,424 issued Dec. 19, 1876 describes a file having metal teeth on one side and an emery or other abrading surface on the other side.

Artificial "Carborundum38 and natural stone hones are well known.

It is apparent from the foregoing that the need to sharpen fish hooks and a wide variety of means for accomplishing this purpose are well known in the art. It is equally apparent, however, that a need has long existed in the art for a means for the rapid and simple sharpening of multi-point fish hooks such as the treble hooks commonly employed on a wide variety of lures, and the double hooks commonly used in fishing flies for Atlantic salmon.

SUMMARY OF THE INVENTION

The present invention provides a simple hand-held device for simultaneously sharpening the points of double or treble fish hooks. The device consists essentially of a concave sharpening member having a pair of opposed, spaced apart, downwardly converging planar walls dimensioned to simultaneously contact the points of a pair of hooks of a multiple hook positioned in the sharpening member. In the preferred embodiment, the downwardly converging walls meet at the lower edges thereof to form a longitudinally elongated channel which contacts the point of a treble hook placed in the sharpening member with the points of the other two hooks in contact with the diverging walls. In the preferred embodiment of the invention the hook sharpening member has a V-shaped cross section. In another embodiment, the cross section of the concave hook sharpening member may be U-shaped or indeed any other shape that permits the generally upright walls to simultaneously contact the points of two hooks of a multiple hook.

While, as noted above, only the hook-sharpening member is essential, it is preferred that it be connected to a handle which is easily held in the fingers of one hand of the user.

DETAILED DESCRIPTION OF THE INVENTION

The invention will now be described in greater detail in conjunction with the accompanying drawings in which:

FIG. 1A is a perspective view of a treble hook showing its various parts;

FIG. 1B is a perspective view of a double hook;

FIG. 2 is a perspective view of a preferred hook sharpening device of the invention;

FIG. 3 is a perspective view of the device of FIG. 2 showing a treble hook to be sharpened;

FIG. 4 is a cross-sectional view of a hook sharpening member alone of the type forming a part of the device of FIG. 3 and showing a treble hook in position to be sharpened;

FIG. 5 is a perspective view of another embodiment of the invention; and

FIG. 6 is a cross-sectional view of still another embodiment of the invention showing a double hook in the hook sharpening member.

Multiple fish hooks of the type to be sharpened with the device of the present invention are shown in FIG. 1. More specifically, FIG. 1A shows a treble hook 10 having three single hooks 12 with their individual shafts 14 joined to form a common composite shaft 14A. The individual hooks 12 are disposed radially and are spaced 120° apart, as is the common practice. Each hook 12 has a bend 16 continuing from the shaft 14 and terminating in a spear 18 having a point 20 and a barb 22. The barbs 22 may be filed or pressed down or omitted altogether to facilitate release of fish in sporting catch-and-release fishing. The space separating the point 20 and shaft 14 is called the gape 24 of the hook.

FIG. 1B shows a double hook in which two hooks 12, identical to those in FIG. 1A, are radially disposed spaced 120° apart on the composite shaft 14B. Such double hooks are commonly used in artificial flies for Atlantic salmon, whereas the treble hooks of FIG. 1A are employed universally for many types of fishing lures for both fresh and salt water use.

The treble hook of FIG. 1A and the double hook of FIG. 1B are each provided with an eye 28 for attachment of the fishing leader or line.

A preferred hook sharpening device 30 of the present invention is shown in FIG. 2 as having a handle 32, a hook sharpening member 34 and an intermediate connecting member 36. Only the hook sharpening member 34 is essential; the handle 32 and intermediate member 36, being preferred but not essential. As shown in FIG.

2, the handle 32, hook sharpening member 34 and intermediate connecting member 36 are preferably formed integrally from a single sheet of metal or plastic although these elements can obviously be formed separately and suitably connected.

The concave hook sharpening member 34 as shown in FIGS. 2, 3, 4 and 5, has a V-shaped cross section and is composed of a pair of opposed, spaced apart, upwardly diverging planar walls 38 connected or meeting at their lower edges in the channel 40. As shown in the embodiment of FIG. 2, the elongated channel 40 at the bottom of the V-shaped element 34 is parallel with the upper edges of the walls 38. While this is desirable, it is not essential.

The handle 32 of the device 30 may be generally flat as shown in FIG. 2 or may have any suitable configuration adapted to be held by the fingers of one hand of the user. A hole 42 is provided in the handle 32 to permit hanging of the device in any convenient manner for easy access such as on the fishing vest of the user. The device is, of course, of a size to be carried in a pocket.

The intermediate connecting member 36 of the device 30, as shown in FIG. 2, may be a necked-down structure having a pair of inwardly and downwardly converging walls 44 disposed between the handle 32 and the walls 38 of the element 34. An intermediate wall 46 of the member 36 extends between the handle 32, the side walls of 36 and channel 40 and has a generally triangular configuration.

At least the inner surfaces of the walls 38 and channel 40 of the hook sharpening member 34 of the device are abrasive and capable of sharpening a fish hook. Any suitable abrasive may be employed. The preferred abrasive, as shown in FIG. 2, is finely particulate diamond. The means of providing a plastic or metal surface with diamond abrasive are well known in the art.

While the V-shaped cross section of the concave hook sharpening element 34, as shown in FIGS. 2, 3, 4 and 5, is preferred, any other suitable configuration such as the U-shaped structure shown in FIG. 6 may be employed. It is only essential that the cross section of the element 34 permit at least two hooks to be sharpened simultaneously by contact with the side walls 38 and, if a treble hook is to be sharpened, with the point of the third hook in contact with the channel 40.

The sides 38 of the U-shaped structure of FIG. 6 are the full equivalent of the walls 38 of the V-shaped structure of FIGS. 2, 3, 4 and 5. Similarly, the bottom of the U-shaped structure of FIG. 6 is the full equivalent of the channel 40 of the V-shaped structure of FIGS. 2, 3, 4 and 5.

In another embodiment of the invention shown in FIG. 5, hook sharpening member 48 and intermediate connecting portion 36 are disposed at a downward acute angle to the handle 32 to provide a downwardly slanting channel 40.

The use of the devices of the invention is shown in FIGS. 3 and 5 in which a treble hook 10 is shown partially inserted in the hook sharpening member. When fully inserted the points 20 of two hooks 12 are in contact with the walls 38 and the point 20 of the third hook is in contact with the channel 40 as shown in FIG. 4.

The devices of FIGS. 2, 3 and 5 with a V-shaped configuration of the sharpening element, could also have the U-shaped configuration of the device of FIG. 6; the operation of either type of device being the same. As shown in FIGS. 4 and 6, the hook sharpening members may have no handles 32 or connecting members 36.

In an operation for sharpening a multiple hook, the device 30 is held in the fingers of one hand, either by the the handle 32 or by gripping the hook sharpening member 34 directly if it has no handle, as in FIGS. 4 and 6. The hook to be sharpened is held by the composite shaft 14A or 14B in the fingers of the user's other hand. The multiple hook is then inserted into the cavity of the hook sharpening member 34 with the points 20 of the hook in contact with at least the pair of walls 38 if a double hook, and also in contact with the channel 40 if a treble hook. The multiple hook is then drawn longitudinally of the hook sharpening member with all points of the hook in simultaneous contact with the abrasive surfaces. Several strokes of the hook in one direction or reciprocal strokes back and forth in the device exerting light pressure serve to sharpen all points of the hook simultaneously.

The preferred and most useful device of the invention is formed of a sheet of stiff metal about 3" long and 1½" wide, with a flat handle 32 about 1½" long, a formed connecting portion 36 about ¾" long and a hook sharpening member about ¾" long. The upwardly diverging sides 38 are about ⅝" high and about ¾" long. The space between the opposed sides 38 is about ¾", making the included angle between the sides about 60°, more or less. Such a device is of a convenient size to be carried in a pocket or hung from a fishing vest and is suitable for sharpening double or treble hooks from the smallest to the largest commonly employed; i.e., from about size 14 up to about size 1 or even as large as size 1/0, 2/0 or 3/0. This provides a tool suitable for virtually all fresh water fishing and for most salt water hooks as well. A larger tool may be provided to sharpen really large hooks in the range from 1/0 up to 5/0 or even for giant hooks up to 14/0 or larger. In devices of such large sizes, the abrasive material must be correspondingly coarse in order to sharpen the large hook points. In general, the small tool is suitable for hooks having a gape up to about ½"; i.e., about size 3/0. A 6/0 hook has a gape of about ¾", and an 8/0 hook, a gape of about 1"; therefore, a tool for hooks of this size or larger must have sides 38 greater than ¾" deep; i.e., up to 1½"deep or more for giant hooks.

As is apparent from the foregoing, it is of primary importance that the points 20 of the hooks be sharpened, but it is also possible and sometimes desirable to fine down the entire spear of the hooks as well.

What is claimed is:

1. A hand-held device for simultaneously sharpening multiple fish hooks having a plurality of individual hook points disposed around a common shaft means, each of said individual fish hooks having a spear and a point; said device being formed from sheet metal and comprising:

a) hook sharpening means, b) handle means, and c) intermediate means connecting said hook sharpening means and handle means;

said hook sharpening means having a V-shaped cross section formed by a pair of opposed, spaced apart, planar walls meeting to form a channel at the bottom of said V-shaped cross section;

said planar walls diverging upwardly and outwardly from said channel at an angle such that at least two points of a multiple hook placed in said hook sharpening means simultaneously contact said planar walls;

the inner surfaces of said planar walls and channel being abrasive;

said intermediate connecting means comprising a pair of opposed spaced apart side walls diverging inwardly from said handle means and integral with the opposed spaced hook sharpening means, and a generally triangular rear wall integral with said handle means and extending downwardly therefrom, said rear wall also being disposed between and integral with the side walls of said connecting means.

2. A device of claim 1 in which a treble hook placed on said hook sharpening means will have a hook point simultaneously in contact with each of said planar walls and said channel.

* * * * *